United States Patent [19]

Sterling

[11] 4,246,945

[45] Jan. 27, 1981

[54] HAMPER HOOD

[75] Inventor: Noel S. Sterling, Northbrook, Ill.

[73] Assignee: Medline Industries, Inc., Northbrook, Ill.

[21] Appl. No.: 92,547

[22] Filed: Nov. 8, 1979

[51] Int. Cl.[3] ..... A45C 11/00

[52] U.S. Cl. ..... 150/51; 150/52 R

[58] Field of Search ..... 150/48, 49, 50, 51, 150/52 E, 52 R, 3, 7

[56] References Cited

U.S. PATENT DOCUMENTS

| | | | |
|---|---|---|---|
| 2,338,279 | 1/1944 | Blake | 150/7 |
| 2,490,250 | 12/1949 | Boener | 150/52 R |
| 2,767,757 | 10/1956 | Marder | 150/51 |
| 2,789,610 | 4/1957 | Pritchard | 150/7 |
| 2,821,230 | 1/1958 | May | 150/52 R |

*Primary Examiner*—Donald F. Norton

*Attorney, Agent, or Firm*—Dressler, Goldsmith, Shore, Sutker & Milnamow, Ltd.

[57] ABSTRACT

A hamper hood for use with a hamper stand and hamper bag comprises a circular sidewall and circular top. The top is comprised of two partially overlapping flaps which are semi-circular. Each flap is secured to the sidewall along its entire curved peripheral part and is unsecured along its straight peripheral part so that the unsecured peripheral part of one flap substantially overlaps the unsecured peripheral part of the other flap to assume a fully closed position. The flaps are maintained taut, generally flat and in contact with each other along their entire overlapping region due to tension supplied by the frame opening of the hamper stand, but are separable for insertion of laundry articles therebetween.

6 Claims, 3 Drawing Figures

HAMPER HOOD

TECHNICAL FIELD

This invention relates to covers for hamper bags for use in laundry depositing systems.

BACKGROUND OF THE INVENTION

In laundry depositing systems, especially in medical and hospital facilities, extensive precautions and care must be utilized to control the spread of germs and bacteria. Soiled laundry articles must be conveniently stored until they are removed for laundering, and hamper bags have been used for this purpose.

However, germs and bacteria become airborne and leave the soiled laundry articles to contaminate the atmosphere, thereby undesirably spreading germs to patients, medical personnel, pieces of medical apparatus and medical supplies. Prior art hamper hoods that include a side wall and a top wall comprising a pair of flaps have been used to attempt to control the spread of this airborne bacteria, but have not totally succeeded due to a gap which exists between the flaps after laundry is deposited into the laundry hamper bag. This gap in the hamper hood has allowed infectious germs to become airborne and contaminate the atmosphere and has also allowed germ-carrying insects attracted to the soiled laundry to gain access to the interior of the bag and thereafter escape, carrying infectious germs out of the bag to contaminate other articles. Control of these infectious germs is of utmost importance and prior to the present invention, control of these germs has not been satisfactorily achieved.

Another device attempting to control airborne germs is a hamper lid made of plastic or like composition. However, upon tilting a lid of this type to gain access to the hamper bag to deposit soiled laundry articles, airborne germs that have built up inside of the laundry bag are immediately released in large quantities, and contaminate the atmosphere. Also, because these lids are made of a non-cloth material, they require separate sanitary procedures to disinfect the germs that build up thereon.

SUMMARY OF THE INVENTION

The foregoing disadvantages of the prior art are overcome with the present invention which provides a hamper hood comprised of a side wall and top. The top of the hamper hood is comprised of two flaps, each being secured to the side wall along one part of its periphery, and also includes an unsecured peripheral portion. The unsecured flap peripheral portions form an overlapping region so that they can be separated to create an opening for insertion of laundry articles, where they can be moved from the normal overlapped and substantially closed position, minimizing any air gap between the flaps' peripheral portions, to an open position in which a gap is created between the flaps for insertion of laundry articles. The gap between the flaps is created by grasping and moving one or both of the flaps. When the flaps are released, they return to the overlapped position.

Two handles are disposed on the hamper hood, each being located on an opposite side of the hood at a point where the flaps overlap near the side wall. Pulling these handles away from each other operates to further insure that the flaps are fully overlapped and the hood is fully closed.

BRIEF DESCRIPTION OF THE DRAWING

The various features of the invention will be seen from the following drawing, in which.

DESCRIPTION OF THE PREFERRED EMBODIMENTS

Figure 1:
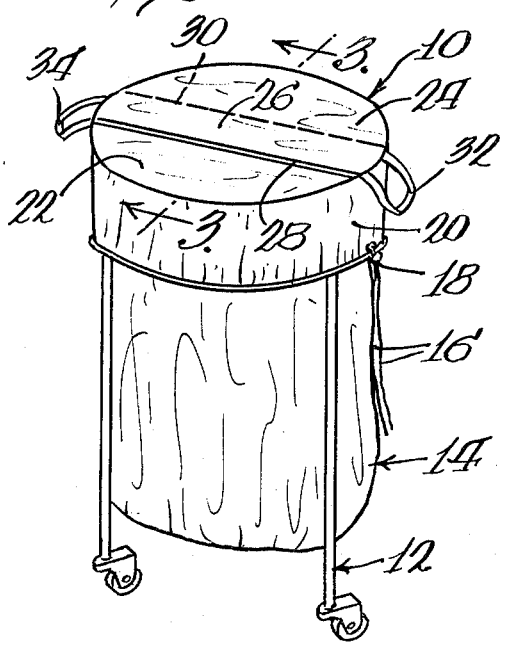
FIG. 1 is a perspective view of the hamper hood of the present invention mounted along with a hamper bag on a hamper stand, the hood being shown in a fully closed position.

While this invention is susceptible of embodiment in many forms, there is shown in the drawing and will be described herein in detail a preferred embodiment of the invention. It should be understood, however, that the present disclosure is to be considered as an exemplification of the principles of the invention and is not intended to limit the invention to the embodiment illustrated. The scope of the invention will be pointed out in the appended claims.

Referring now to the drawing, FIG. 1 shows the hamper hood 10 of the present invention installed on a conventional hamper stand 12 which also supports a conventional hamper bag 14. After the hood 10 is placed over the stand 12, the draw strings 16 are pulled taut and secured in place by locking device 18.

The hamper hood 10 has a side wall 20 and a top comprised of two flaps 22 and 24. As shown in FIG. 1, the top is generally circular in shape and the two flaps are generally semi-circular in shape. Each of the flaps is secured along the curved portion of its periphery to the upper edge of side wall 20. The unsecured peripheral part of the flap is that portion of the flap's edge that is not secured to the side wall.

In the preferred embodiment, a first flap 22 is slightly larger than one-half the total area of the top of the hamper hood. A second flap 24 is also slightly larger than one-half of the area of the top. Thus, when second flap 24 is secured to the upper edge of the side wall 20, it substantially overlaps first flap 22 at a position spaced apart from the unsecured peripheral part of the first flap; and the unsecured peripheral part of the first flap also substantially overlaps the second flap at a position spaced apart from the unsecured part of the second flap to form a generally rectangular overlapping region 26 along the length of the unsecured peripheral edges of the flaps. When the flaps are fully overlapped they define a fully closed overlapping position and serve to prevent any airborne bacteria inside of the bag 14 from escaping out of the bag and contaminating the atmosphere.

Preferably, the top of the hamper hood is approximately the same size as the overall size of the hamper stand 12 at its top so that the hamper stand 12 maintains the hamper hood top taut. This insures that the unsecured peripheral parts of the flaps are generally flat, with the portion of each flap in the overlapping region 26 being juxtaposed and in contact with each other.

Moreover, the entire unsecured peripheral edges 28 and 30 of each flap are juxtaposed to, and generally in contact with, a portion of the opposing flap in the overlapping region 26, when one is not separating the flaps. Pulling the draw strings 16 taut and securing the same by conventional locking device 18 further insures that the hamper hood will remain taut and firmly in place on the hamper stand 12.

Figure 2:
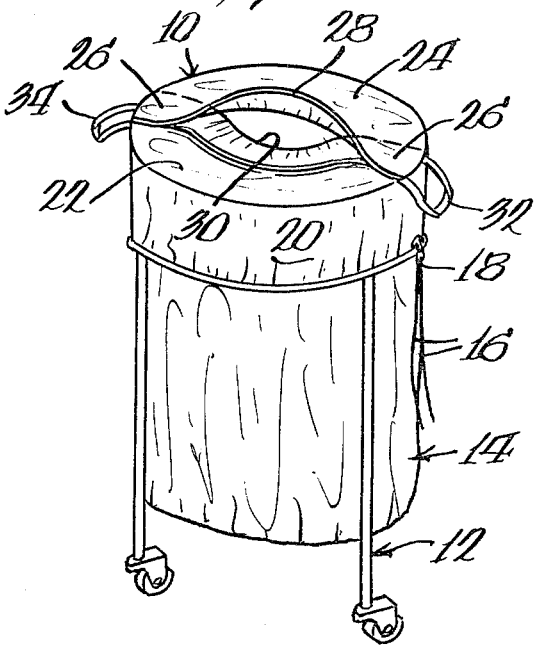
FIG. 2 is a perspective view of the hamper hood mounted as in FIG. 1, but with the flaps separated to create an opening.
Figure 3:
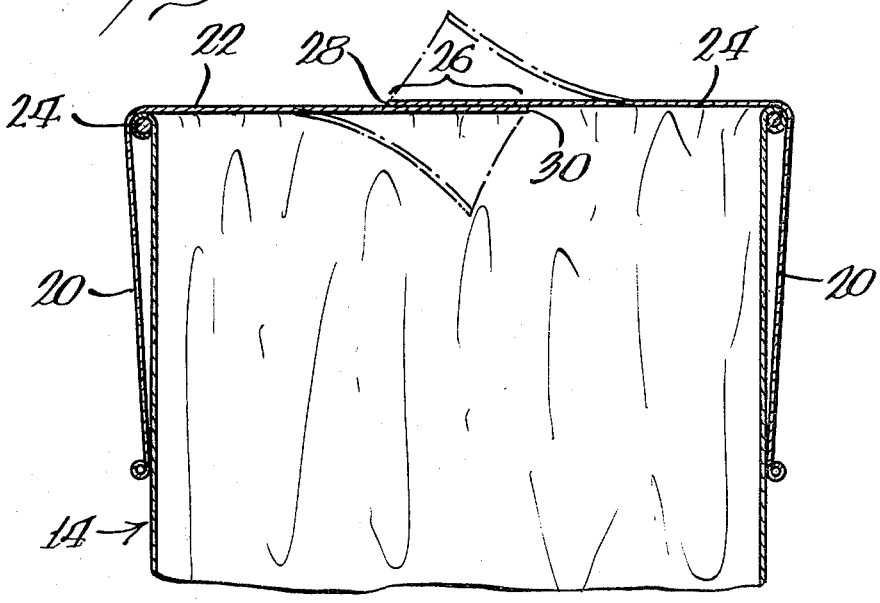
FIG. 3 is a cross-sectional side view of the hamper hood taken along line 3—3 of FIG. 1, shown with the flaps in the fully closed overlapping position, and showing in phantom the position of the flaps when they are separated as shown in FIG. 2.

When one desires to insert laundry articles into the hamper bag 14, one need merely place the article on top of bottom flap 22 and slide it fully underneath the peripheral edge 28 of flap 24 and over the peripheral edge 30 of bottom flap region 22, whereupon it will drop into the interior of hamper bag 14. During this insertion operation, one need only separate the flaps an amount sufficient for the laundry article to pass through the respective flaps, thereby minimizing the air space where airborne bacteria inside the bag 14 can escape to the atmosphere. After the laundry article is inserted, the respective flaps assume their fully closed overlapping position due to the tension on the hamper hood top provided by the hamper stand and thus substantially eliminate any airborne bacteria inside the bag from escaping. The separated flaps are illustrated in FIG. 2. The flaps are shown in the fully closed position in FIG. 3 in solid lines, and the open position is depicted in phantom.

By way of example, the diameter of the top is preferably about 18 (45 centimeters), the diameter of some standard hamper bags and stands presently used in the industry, and the width of the rectangular overlap region 26 is approximately 4 inches (10 centimeters). This relationship of diameter length to overlap width sufficiently creates a substantial overlap, so that the flaps assume an overlapping position after a laundry article has been inserted.

Also shown in FIGS. 1 and 2 are two handles 32 and 34, each positioned at opposite sides of the top of the hamper hood where the second flap 24 overlaps the first flap 22 near the side wall 20. Each of the two handle ends is secured to the hood at a different corner of the generally rectangular overlap region 26, at the ends of peripheral edges 28 and 30.

After a laundry article is inserted through the flaps, one may pull these handles away from each other to further insure that the hood assumes a fully closed position. Since the handles are mounted at the corners of the generally rectangular overlap region 26, pulling the handles away from each other will insure that the peripheral edge 28 of flap 24 and the peripheral edge 30 of flap 22 are fully extended and straight. However, due to the substantial overlap of the flaps created by the relationship of hood diameter to overlap region width and the tautness on the hamper hood top provided by the hamper stand 12 and drawstrings 16, it is not required to pull on the handles for the hood to assume a closed position.

Although the preferred embodiment illustrated and described has a circular configuration, the hamper hood is capable of assuming other configurations, such as a rectangular.

What is claimed is:

1. A hamper hood comprising:

a side wall having an upper edge;

a top comprising two flaps each having a periphery, the first flap having part of its periphery secured to a portion of the upper edge of the side wall and having an unsecured peripheral part, and the second flap having part of its periphery attached to at least the remainder portion of the upper edge of the side wall and having an unsecured peripheral part, such that the unsecured peripheral part of the second flap substantially overlaps the first flap at a position spaced apart from the unsecured peripheral part of the first flap, and the unsecured peripheral part of the first flap substantially overlaps the second flap at a position spaced apart from the unsecured peripheral part of the second flap to assume a fully closed position and wherein the unsecured peripheral parts of the respective flaps are separable for insertion of laundry articles therebetween.

2. The hamper hood of claim 1 wherein a handle is secured to the hamper hood at each of the two locations where the second flap overlaps the first flap adjacent the side wall, so that pulling the handles away from each other further insures that the hood is fully closed.

3. The hamper hood of claim 2 wherein each handle has a first secured end that is secured to the hood where the unsecured peripheral part of the first flap meets the side wall and a second secured end that is secured to the same side of the hood where the unsecured peripheral edge of the second flap meets the side wall.

4. A hamper hood for use with a hamper stand and bag mounted on such stand comprising:

a side wall having a lowermost edge extending below the uppermost edge of the bag;

a top having approximately the same size as the overall size of the hamper stand at its top, comprising two flaps each having a periphery, the first flap having part of its periphery secured to a portion of the upper edge of the side wall and having an unsecured peripheral part, and the second flap having part of its periphery secured to at least the remainder portion of the upper edge of the side wall and having an unsecured peripheral part, so that the unsecured peripheral part of the second flap substantially overlaps the first flap at a position spaced apart from the unsecured peripheral part of the first flap, and the unsecured peripheral part of the first flap substantially overlaps the second flap at a position spaced apart from the unsecured peripheral part of the second flap whereby the hamper stand maintains the top taut to insure that the flaps are generally flat and juxtaposed to assume a fully closed position, but wherein the unsecured peripheral parts of the respective flaps are separable for insertion of laundry articles therebetween.

5. The hamper hood of claim 4 wherein the top is generally circularly shaped and wherein each of the two flaps is generally semi-circularly shaped and has an area at least one-half the area of the circularly shaped top.

6. A hamper hood for use with a hamper stand and a bag mounted on such stand comprising:

a side wall having a lowermost edge extending below the uppermost edge of the bag;

a generally circularly shaped top having approximately the same size as the overall size of the hamper stand at its top, comprising two generally semi-circularly shaped flaps, each flap having an area at least one-half the area of the top, the first flap having the curved portion of its periphery secured to a major portion of the upper edge of the side wall and having an unsecured peripheral part, and the second flap having the curved portion of its periphery secured to at least the remainder portion of the upper edge of the side wall and having an unsecured peripheral part, such that the unsecured portion of the second flap region substantially overlaps the first flap at a position spaced apart from the unsecured peripheral part of the first flap, and the unsecured peripheral part of the first flap substantially overlaps the second flap at a position spaced apart from the unsecured peripheral part of the second flap whereby the hamper stand maintains the top taut to insure that the flaps are generally flat and juxtaposed to assume a fully closed position, but wherein the unsecured peripheral parts of the respective flaps are separable for insertion of laundry articles therebetween; and two handles, each having a first secured end that is secured to the hood where the unsecured peripheral part of the first flap meets the side wall, and a second secured end that is secured to the same side of the hood where the unsecured peripheral edge of the second flap meets the side wall, so that pulling the handles away from each other further insures that the hood is fully closed.

* * * * *